US006685448B1

(12) United States Patent
Grosch et al.

(10) Patent No.: US 6,685,448 B1
(45) Date of Patent: Feb. 3, 2004

(54) WATER PUMP

(75) Inventors: Wayne A. Grosch, Dublin, GA (US); George Mike Fritton, Silver Creek, NE (US)

(73) Assignee: Major Turbine Pump & Supply Co., Dublin, GA (US)

( * ) Notice: Subject to any disclaimer, the term of this patent is extended or adjusted under 35 U.S.C. 154(b) by 27 days.

(21) Appl. No.: 10/066,931

(22) Filed: Feb. 4, 2002

(51) Int. Cl.[7] ..... B05B 13/02
(52) U.S. Cl. ..... 417/424.1
(58) Field of Search ..... 417/424.1, 423.5, 417/423.3

(56) References Cited

U.S. PATENT DOCUMENTS

| | | | | |
|---|---|---|---|---|
| 890,764 A | | 6/1908 | Geare | |
| 3,010,402 A | | 11/1961 | King | |
| 3,048,118 A | | 8/1962 | Erd | |
| 3,677,666 A | * | 7/1972 | Tybus | 417/424.1 |
| 3,698,830 A | | 10/1972 | Goyne | |
| 3,936,221 A | * | 2/1976 | Lobanoff | 417/424.1 |
| 4,934,914 A | | 6/1990 | Kobayashi et al. | |
| 5,203,681 A | * | 4/1993 | Cooper | 417/424.1 |
| 5,330,328 A | * | 7/1994 | Cooper | 417/424.1 |
| 5,336,064 A | | 8/1994 | Lamers | |
| 5,571,001 A | | 11/1996 | Fukuda et al. | |
| 6,149,390 A | * | 11/2000 | Fisher et al. | 417/424.1 |
| 6,187,096 B1 | * | 2/2001 | Thut | 417/424.1 |
| 6,206,097 B1 | * | 3/2001 | Stephens | 417/424.1 |
| 6,315,530 B1 | * | 11/2001 | Goodnick et al. | 417/424.1 |
| 6,345,964 B1 | * | 2/2002 | Cooper | 417/424.1 |
| 6,471,495 B1 | * | 10/2002 | Allen et al. | 417/424.1 |
| 6,474,962 B1 | * | 11/2002 | Allen et al. | 417/424.1 |

* cited by examiner

*Primary Examiner*—Henry C. Yuen
*Assistant Examiner*—Jason Benton
(74) *Attorney, Agent, or Firm*—Thomte, Mazour & Niebergall; Dennis L. Thomte

(57) ABSTRACT

A pump for pumping water, other liquids, or slurry mixes is described and includes an electric motor or the like positioned above the water to be pumped which has a rotatable pump shaft extending downwardly therefrom which has a drive line shaft connected thereto and which extends downwardly therefrom through a casing. A pump is secured to the lower end of the casing and includes a plurality of vertically spaced-apart pump impellers mounted on a pump shaft which rotate with the drive line shaft. A discharge line extends from the lower end of the pump to a location remote from the pump. Water inlets are provided in the casing below the water line so that operation of the pump by the electric motor will cause water to be sucked into the interior of the casing and to be drawn into the interior of the pump for discharge from the lower end of the pump.

9 Claims, 2 Drawing Sheets

WATER PUMP

BACKGROUND OF THE INVENTION

1. Field of the Invention

This invention relates to a water pump and more particularly to a water pump wherein the motor or engine for driving the same is located above the water level and wherein the discharge water is pumped from the lower end of the pump, upwardly through a discharge line to a location remote from the water being pumped. This invention eliminates the need of a high pressure stuffing box which is normally necessary in most pumps wherein the discharge water is passed upwardly through the drive line shaft casing.

2. Description of the Related Art

Many types of water or liquid pumps have been previously devised. One type of prior art pump is illustrated in FIG. 1 and identified as prior art. In the apparatus of the prior art, an electric motor 10 or engine or positioned above the water 12 to be pumped with the water 12 having a water level 14. In the prior art pump of FIG. 1, a drive line shaft 15 is secured to the power shaft of the electric motor 10 for rotation therewith. The drive line shaft 15 extends downwardly through a high pressure stuffing box 16, and through a housing 18 having a discharge outlet 20 at one side thereof. A drive line shaft casing 22 extends downwardly from the housing 18 and normally has bearings positioned therein for supporting the drive line shaft 15. A conventional water pump 24 is secured to the lower end of the casing 22 which normally includes a plurality of vertically spaced-apart pump impellers which are mounted on a pump shaft which is operatively connected to the lower end of the drive line shaft 14. The pump 24 has an inlet opening 26 at its lower end. When the pump 24 is actuated by the electric motor or engine, the rotation of the drive line shaft 15 causes the impellers in the pump 24 to draw water into the lower end thereof and to pump the water upwardly through the casing 22, through housing 18 and outwardly through discharge opening 20 to which is normally connected a pipe or the like.

The prior art device of FIG. 1 requires that a high pressure stuffing box 16 be included which results in wearing of the head shaft or replacement of the packing therein. The upward movement of the water through the casing 22 and the housing 18 can also result in water coming into contact with the electric motor 10 or the gear drive thereof if the same is utilized.

SUMMARY OF THE INVENTION

A high pressure, high flow pump is provided for pumping water. An electric motor or engine is positioned above the water to be pumped and has a rotatable power shaft extending downwardly therefrom which has a drive line shaft secured thereto and which extends downwardly therefrom through a casing. A plurality of vertically spaced-apart bearings are provided in the casing for supporting the drive line shaft. A pump is secured to the lower end of the casing and includes a plurality of pump impellers therein which are driven by a pump shaft operatively connected to the drive line shaft. One or more water inlets are formed in the casing above the pump and below the water level so that water will be drawn therethrough into the interior of the casing and will be drawn down into the pump upon actuation of the electric motor. A discharge pipe or conduit is connected to the discharge side of the pump and extends upwardly therefrom to a location remote from the water to be pumped. The pump of this invention eliminates the need of high pressure stuffing boxes and seal assemblies.

It is therefore a principal object of the invention to provide an improved water pump.

Still another object of the invention is to provide an improved water pump which eliminates the need for high pressure stuffing boxes or the like.

Still another object of the invention is to provide a pump of the type described wherein water is discharged from the pump upwardly through a discharge pipe to a location remote from the water to be pumped.

Still another object of the invention is to provide a water pump which has high pressure capability.

Still another object of the invention is to provide a water pump having high flow capabilities.

Still another object of the invention is to provide a water pump which may pump slurry mixes.

Still another object of the invention is to provide a pump which requires low maintenance.

These and other objects will be apparent to those skilled in the art.

DESCRIPTION OF THE PREFERRED EMBODIMENT

Figure 1:
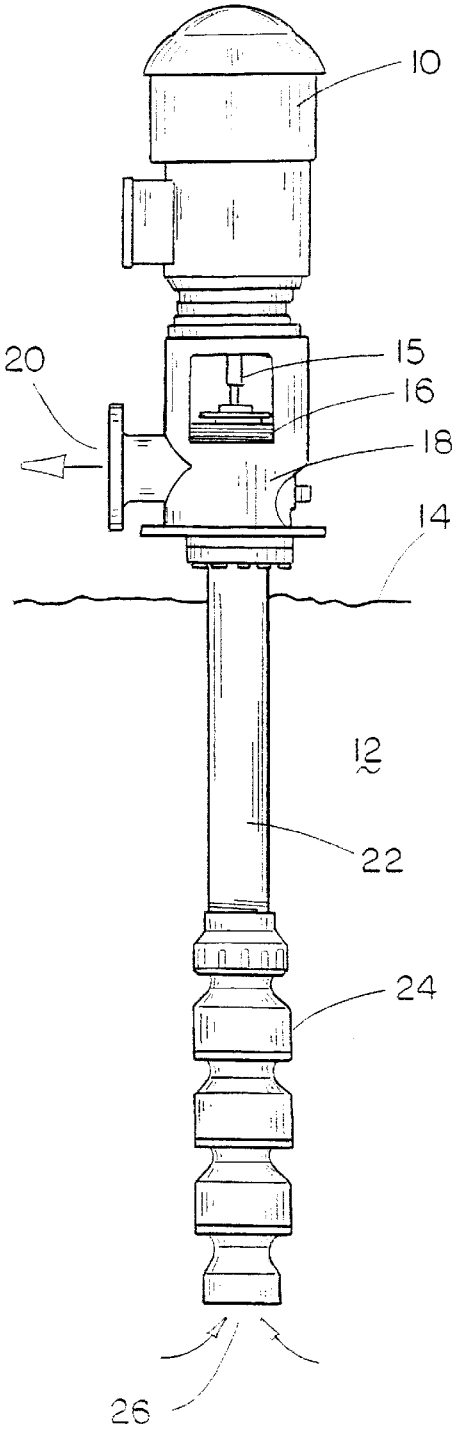
FIG. 1 (PRIOR ART)
FIG. 1 is a side view of a conventional prior art water pump.

The pump of this invention is referred to generally by the reference numeral 30 and includes a power means 32 which may comprise an electric motor or an engine. Pump 30 is designed to pump water or slurry mixes or other types of liquids. As in FIG. 1, the numeral 12 refers to the water to be pumped having a liquid level 14.

Figure 2:
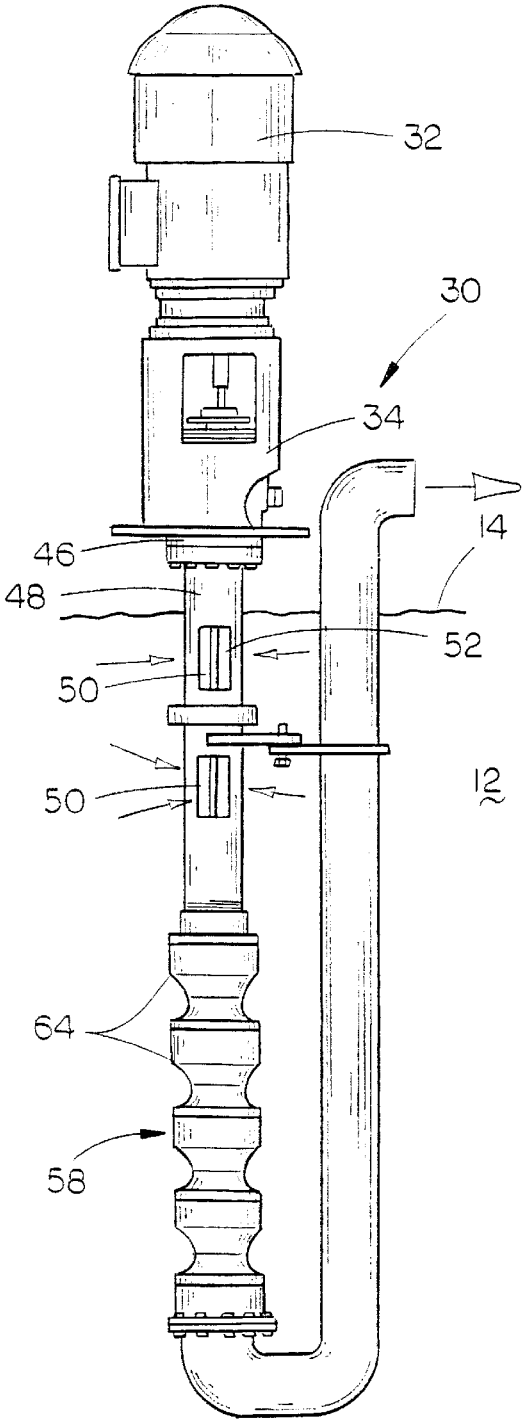
FIG. 2 is a side view of the pump of this invention.
Figure 3:
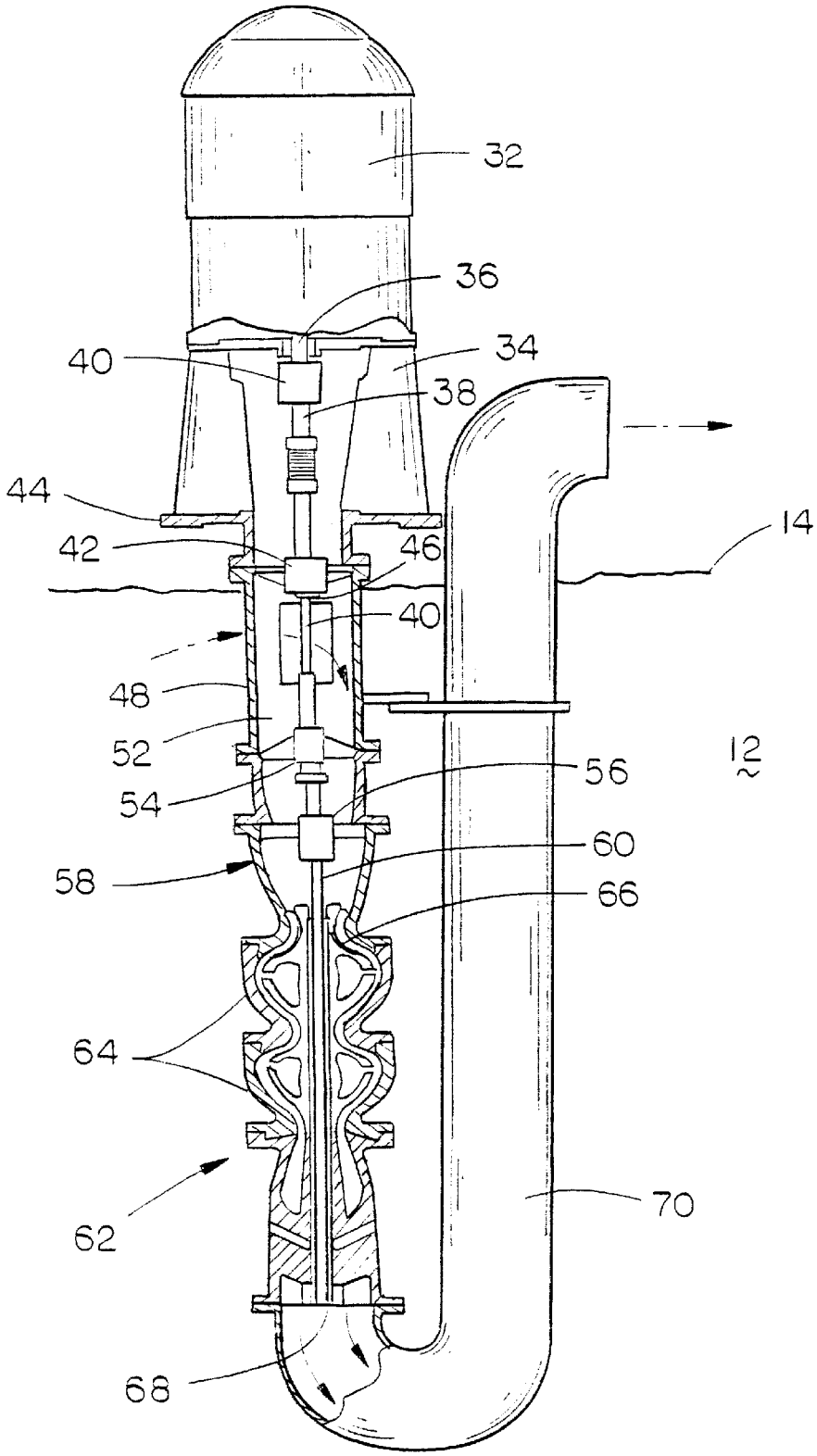
FIG. 3 is a sectional view illustrating the pump of this invention.

Housing 34 is secured to the lower end of the motor 32 for supporting the same. Motor 32 includes a power shaft 36 which is coupled to shaft 38 by coupling 40. The lower end of shaft 38 is coupled to drive line shaft 40 by means of coupling 42. If desired, the upper end of drive line shaft 40 could be directly coupled to the power shaft 36 by means of a suitable coupling. The lower end of housing 34 is supported upon a base plate 44 which would normally be secured to a suitable supporting surface by any convenient means. A radial bearing 46 is preferably positioned on the lower end of the housing 34, as seen in FIG. 2, for supporting the drive line shaft 42 therein. Casing 48 extends downwardly from the radial bearing 46 and has one or more water inlet openings 50 formed therein below the water line 14. For purposes of description, the casing 48 will be described as including an interior 52.

The numeral 54 refers to a rubber bearing and retainer of conventional design which supports the drive line shaft 42 within the casing 48. The numeral 56 refers to a conventional marine bearing which is located in the upper end of pump housing 58 for supporting the drive line shaft 40 and/or the pump shaft 60 therein. Pump shaft 60 forms a part of the pump means 62 which comprises a plurality of pump housing sections 64 which are connected together in an end-to-end relationship, as seen in FIG. 2. A plurality of vertically spaced pump impellers 66 are operatively secured to the pump shaft 60 for rotation therewith within the pump housing sections 64 so that water will be drawn or sucked into the inlet openings 50 into the interior 52 of casing 48 and downwardly into the interior of the pump means 62. The length of the casing 22 and the length of the pump means 62 will depend upon the particular environment or in which the pump is used.

The lower end of pump 62 has a discharge opening 68 to which is connected a pump discharge pipe or conduit 70 which extends upwardly therefrom to a location remote from the water being pumped.

A key feature of the pump of this invention is that it not only has high flow capability, but it also has high pressure capability. The pump of this invention will pump water, other liquids, or slurry mixes. The pump may be engine or motor driven, as previously stated. By providing a top suction, i.e., water inlets 50, there is no need for the high pressure stuffing box 16 such as used in the prior art device of FIG. 1. The costly seal assemblies of the prior art are also eliminated due to the fact that the water is being pumped downwardly with respect to the motor rather than being pumped upwardly with respect to the motor. The fact that the water is being pumped away from the motor eliminates the possibility of water getting into the motor or the gear drive thereof.

The pump of this invention is believed to be vastly superior to the prior art pumps and it can therefore be seen that the invention accomplishes at least all of its stated objectives.

We claim:

1. A powered pump for pumping water, comprising:

a power means positioned above the water to be pumped and having a rotatable power shaft extending downwardly therefrom;

a substantially vertically disposed drive line shaft having upper and lower ends;

said upper end of said drive line shaft being connected to said power shaft of said power means for rotation therewith;

a substantially vertically disposed casing, having upper and lower ends, extending around said drive line shaft;

a pump housing, having upper and lower ends;

said upper end of said pump housing being connected to said lower end of said casing;

a water pump positioned in said pump housing which is connected to said drive line shaft;

said casing having at least one water inlet formed therein above said pump housing for permitting water to enter the interior of said casing;

the interior of said casing being in fluid communication with the interior of said pump housing;

a water discharge line having inlet and discharge ends;

said inlet end of said water discharge line being in fluid communication with the discharge side of said water pump;

said water discharge line extending upwardly from said water pump to a location remote from the water to be pumped;

said at least one water inlet being positioned below said discharge end of said water discharge line.

2. The apparatus of claim 1 further including at least one bearing means mounted in said casing for rotatably supporting said drive line shaft.

3. The apparatus of claim 1 wherein said pump housing includes a plurality of pump housing sections secured together in an end-to-end relationship.

4. The apparatus of claim 1 wherein said water pump includes a plurality of vertically spaced-apart impellers.

5. The apparatus of claim 1 wherein said water pump includes a pump shaft which is operatively connected to said drive line shaft.

6. The apparatus of claim 1 wherein said power means comprises an electric motor.

7. The apparatus of claim 1 wherein said power means comprises an engine means.

8. A powered pump for pumping water, comprising:

a power means positioned above the water to be pumped and having a rotatable power shaft extending downwardly therefrom;

a substantially vertically disposed drive line shaft having upper and lower ends;

said upper end of said drive line shaft being connected to said power shaft of said power means for rotation therewith;

a substantially vertically disposed casing, having upper and lower ends, extending around said drive line shaft;

a pump housing, having upper and lower ends;

said upper end of said pump housing being connected to said lower end of said casing;

a water pump positioned in said pump housing which is connected to said drive line shaft;

said casing having at least one water inlet formed therein above said pump housing for permitting water to enter the interior of said casing;

the interior of said casing being in fluid communication with the interior of said pump housing;

a water discharge line having inlet and discharge ends;

said inlet end of said water discharge line being in fluid communication with the discharge side of said water pump;

said water discharge line extending upwardly from said water pump to a location remote from the water to be pumped;

said casing having a plurality of vertically spaced-apart water inlets formed therein.

9. A powered pump for pumping water, comprising:

a power means positioned above the water to be pumped and having a rotatable power shaft extending downwardly therefrom;

a substantially vertically disposed drive line shaft having upper and lower ends;

said upper end of said drive line shaft being connected to said power shaft of said power means for rotation therewith;

a substantially vertically disposed casing, having upper and lower ends, extending around said drive line shaft;

a pump housing, having upper and lower ends;

said upper end of said pump housing being connected to said lower end of said casing;

a water pump positioned in said pump housing which is connected to said drive line shaft;

said casing having at least one water inlet formed therein above said pump housing for permitting water to enter the interior of said casing;

the interior of said casing being in fluid communication with the interior of said pump housing;

a water discharge line having inlet and discharge ends;

said inlet end of said water discharge line being in fluid communication with the discharge side of said water pump;

said water discharge line extending upwardly from said water pump to a location remote from the water to be pumped;

and a plurality of vertically spaced-apart bearings mounted in said casing for rotatably supporting said drive line shaft.

* * * * *